US007028730B2

(12) United States Patent
Pace et al.

(10) Patent No.: US 7,028,730 B2
(45) Date of Patent: Apr. 18, 2006

(54) POCKETBOOK WITH INTERCHANGEABLE COVERS

(76) Inventors: Susan Pace, 361 Union Blvd., West Islip, NY (US) 11795; Laurie McFadden, 361 Union Blvd., West Islip, NY (US) 11795

( * ) Notice: Subject to any disclaimer, the term of this patent is extended or adjusted under 35 U.S.C. 154(b) by 58 days.

(21) Appl. No.: 10/869,542

(22) Filed: Jun. 15, 2004

(65) Prior Publication Data

US 2005/0274441 A1 Dec. 15, 2005

(51) Int. Cl.
*A45C 3/08* (2006.01)

(52) U.S. Cl. ..... 150/105; 150/103; 150/104; 150/108; 150/113

(58) Field of Classification Search ..... 150/103–106, 150/112, 113; 190/26, 110; 383/111
See application file for complete search history.

(56) References Cited

U.S. PATENT DOCUMENTS

| | | | | | |
|---|---|---|---|---|---|
| 1,960,396 | A | | 5/1934 | Rosenberg | 150/28 |
| 1,978,971 | A | | 10/1934 | Thornhill et al. | 150/28 |
| 2,023,144 | A | | 12/1935 | Miller | 150/28 |
| 2,053,464 | A | * | 9/1936 | Dalsheim | 150/105 |
| 2,118,400 | A | | 5/1938 | Goldberg | 150/33 |
| 2,437,382 | A | | 3/1948 | Czap | 150/28 |
| D155,811 | S | * | 11/1949 | Kigere | D3/233 |
| 2,653,640 | A | | 9/1953 | Browning | 150/28 |
| 2,779,373 | A | | 1/1957 | Koepke | 150/28 |
| 2,809,685 | A | | 10/1957 | Lowy | 150/28 |
| 3,182,701 | A | | 5/1965 | Ginsburg | 150/28 |
| 3,234,985 | A | | 2/1966 | Gilbert | 150/29 |
| 4,027,710 | A | | 6/1977 | Keebler | 150/28 |
| 4,263,951 | A | | 4/1981 | Siegel | 150/35 |
| 4,716,947 | A | | 1/1988 | Haddock | 150/106 |
| 4,907,633 | A | | 3/1990 | Eckstein | 150/105 |
| 5,029,344 | A | | 7/1991 | Shannon | 2/69 |
| 5,207,254 | A | | 5/1993 | Fromm | 150/104 |
| 5,533,558 | A | | 7/1996 | Carey et al. | 150/105 |
| 5,628,093 | A | | 5/1997 | Goodale | 24/381 |
| 5,894,975 | A | * | 4/1999 | Holden et al. | 224/582 |
| 6,003,573 | A | | 12/1999 | Owens | 150/104 |
| 6,029,723 | A | | 2/2000 | Baquero et al. | 150/105 |
| 6,047,404 | A | | 4/2000 | Blanks | 2/69 |
| 6,179,025 | B1 | | 1/2001 | Sutton | 150/105 |
| 6,186,201 | B1 | | 2/2001 | Salz | 150/105 |
| 6,382,376 | B1 | * | 5/2002 | Rosen et al. | 190/108 |
| 6,422,278 | B1 | | 7/2002 | Grogan | 150/105 |
| 6,543,499 | B1 | | 4/2003 | McCreery | 150/104 |
| 6,820,664 | B1 | * | 11/2004 | Ritch | 150/103 |
| 2002/0029831 | A1 | * | 3/2002 | Pendergrass | 150/105 |

OTHER PUBLICATIONS

Romag Fasteners, Inc., Magnetic Snaps, © 2004, 1 page.
Lenora Raye, Reversible Handbags, © 2004, 1 page, website http://www.lenoraraye.com/index.asp?trk=5000001.

*Primary Examiner*—Sue A. Weaver
(74) *Attorney, Agent, or Firm*—Alfred M. Walker

* cited by examiner

(57) ABSTRACT

An interchangeable foundation bag, foundation bag system a method of using the foundation bag system is described. In one embodiment, an interchangeable carrying bag system, is provided which includes a discrete inner foundation bag having an inner surface and an outer surface; at least one outer bag having a top periphery, an inner surface, and an outer surface; a first zipper portion connected to the foundation bag; and a second zipper portion connected to the top periphery of a slipcover. The foundation bag, foundation bag system, and method in various embodiments, may preferably use a reversible/non-reversible liner and a reversible/non-reversible handle.

7 Claims, 7 Drawing Sheets

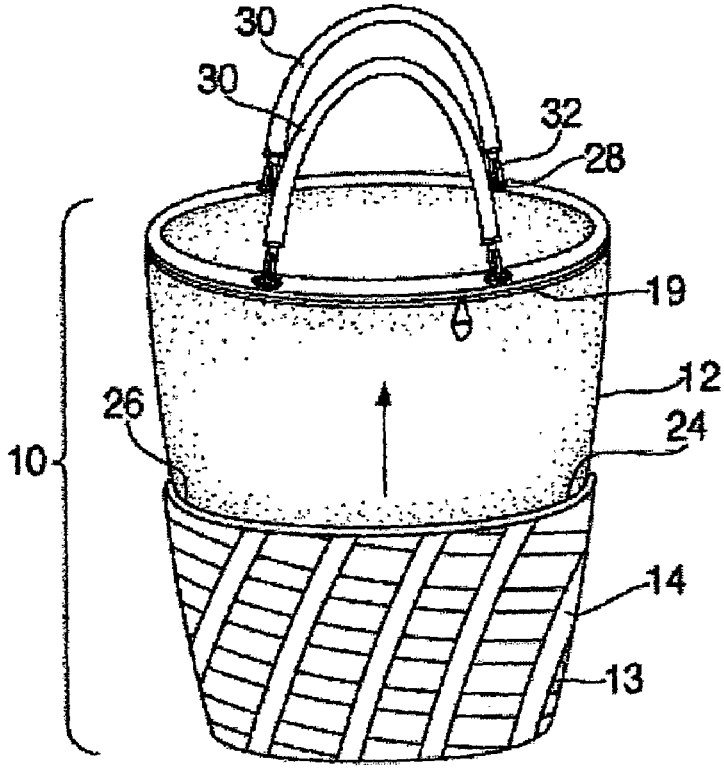
FIG. 1A
FIG. 3C
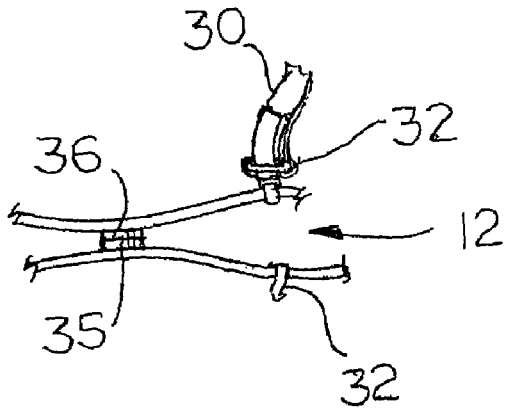

FIG. 3
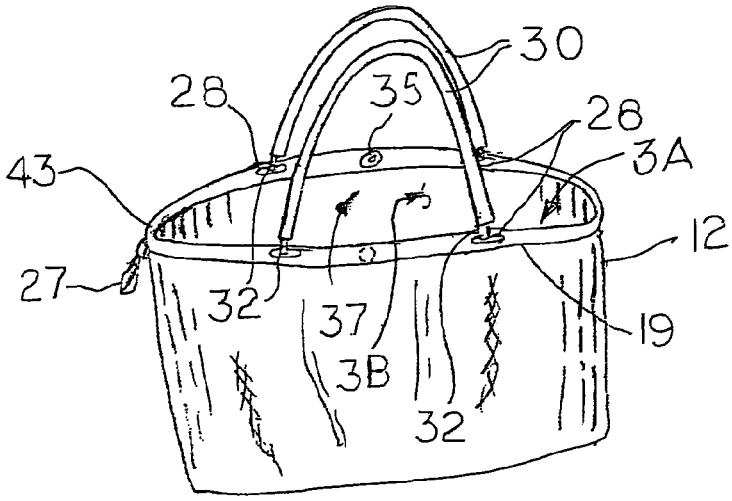
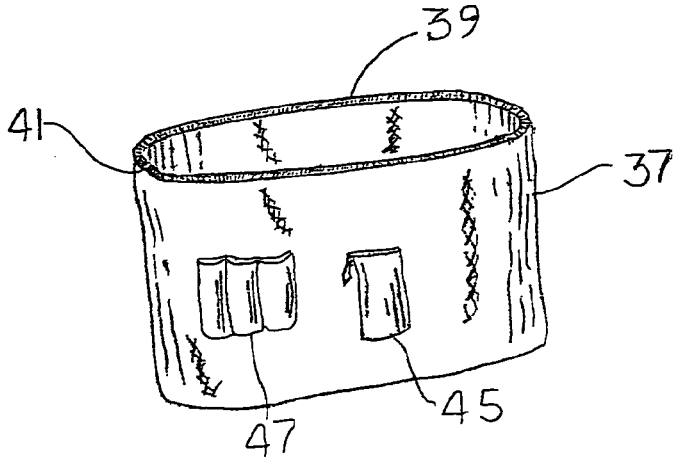
FIG. 3B
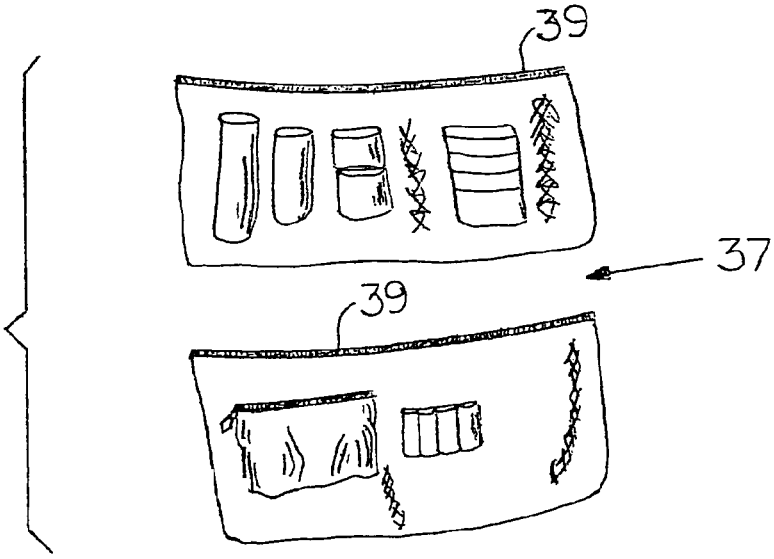
FIG. 3A

POCKETBOOK WITH INTERCHANGEABLE COVERS

BACKGROUND OF THE INVENTION

1. Field of the Invention

Embodiments of the present invention generally relate to handbags and handbag systems. More particularly, the invention relates to a handbag, handbag system and method for using the handbag or handbag system that has one or more interchangeable outer slipcovers. In addition, each of the outer slipcovers, lining and handbag straps can optionally be reversible and/or stackable with each other. The inside of the handbag can also have an optional lining which is removable and reversible and which contains compartments for the storage and safety of various personal items.

2. Description of the Related Art

The roles of women have changed dramatically over the past few decades. The modern woman today is fitness and health conscious; career and goal oriented; a dedicated mother, wife and friend; a homemaker; an individual who travels extensively for work and recreation; or a woman whose role encompasses one or more of the aforementioned. In addition, throughout history, women have also been known to be extremely fashion and accessory conscious. Not only do they purchase clothing to support the roles they have attained in life but have purchased and changed their handbags to enhance each outfit or event.

Women also play multiple roles in any given day (e.g., a morning at the gym, a day at the office, a lunch with friends or colleagues, a late afternoon at the soccer field and an evening out to dinner). Women purchase a multitude of handbags in every color, texture and pattern to match the clothing they wear for each of these events resulting in many problems. For example, one obvious problem is the cost of purchasing so many handbags. In addition, changing handbags daily or multiple times per day to meet the needs of women is not only time consuming but often results in leaving an essential item such as a cell-phone, house key or store return receipt in the prior bag when switched. Other commonly related handbag problems include the inability to clean soil from the handbag's lining and exterior; the handbag that is otherwise good but must be discarded because the bottom is scraped, worn or torn; when traveling, not being able to utilize precious luggage space for clothes because multiple handbags are packed in their place to match the day, evening and casual attire necessary for the trip.

In prior years, various attempts have been made to solve some of these problems but the cited prior patents have not come close to solving them all. The present invention solves them all and more.

For example, known prior art includes "Lenora Raye" handbags with interchangeable handbag covers, as noted in the website www.lenoraraye.com where an inner liner of a handbag has a zipper near a top peripheral edge thereof. The zipper mates with a corresponding zipper located at a top peripheral edge of an interchangeable handbag cover, which can be unzipped and replaced by another handbag cover of a different design. However, the Lenora Raye outer bag covers teach only interchangeable outer bag covers, not multiple reversible covers or, optionally, multiple reversible covers which are plurally stackable within each other.

Additionally Lenora Raye handbags of this design are not based on a fully functional handbag with optional attached covers; instead, a cover must be attached to the inner liner to complete the Lenora Raye handbag. These handbags also do not appear to have reversible straps or liners.

Known patents include U.S. Pat. No. 6,543,499 of McCreery and U.S. Pat. No. 6,186,201 of Salz for interchangeable carrying bag systems, which include a respective inner foundation bag insertable within a respective outer cover of the same shape as the inner foundation bag. However, in McCreery '499 and Salz '201, the inner bag has an annular band of VELCRO® hook and loop fasteners, which mates with an outer annular band of VELCRO® hook and loop fasteners, or linear segments thereof; on a corresponding outer upper edge of the inner foundation bag. The disadvantage is that when the inner foundation bag is used by itself, the outer annular ring of VELCRO® hook and loop fasteners must be covered with a secondary annular fabric ring, or else the wearer's wrist and arm will be irritated by being exposed to and rubbing against the exposed VELCRO® hook and loop fasteners, not zippers. Hence, the outer side surfaces of McCreery's and Salz's inner foundation bags are encumbered by either exposed VELCRO® hook and loop fasteners, or by an annular decorative fabric ring covering the VELCRO® hook and loop fasteners.

U.S. Pat. No. 1,978,971 of Thornhill describes a hand bag and handbag cover which includes an inner bag insertable within an outer cover bag. The inner and outer bags are connected by buttons and button slots, which can be construed as "fasteners."

U.S. Pat. No. 3,234,985 of Gilbert also describes a handbag with changeable covers. In Gilbert '985, the outer cover is attached at a top edge to the inside foundation bag. However, the fastener in Gilbert '985 comprises a linearly extending resilient insert, which is inserted within a linearly extending channel extending along a top edge of the inner bag.

In addition, U.S. Pat. No. 5,628,093 of Goodale and U.S. Pat. No. 6,047,404 of Blanks both describe dual post zippers which include posts at both ends of a zipper tape. These dual post zippers are described for the application of mattress covers and reversible clothing. Thus there is still a need for a handbag which addresses the problems discussed above.

SUMMARY OF THE INVENTION

The present invention generally includes a pocketbook, handbag or purse, but is not limited to and can include a diaper bag, backpack, tote, beach bag, fanny pack, briefcase and or any other carry bag.

In various embodiments, the carrying bag system includes a fully functional foundation bag preferably having a removable inner liner which is optionally reversible. The inner liner features several compartments for storage of personal items such as wallet, cell phone, keys, tissues, etc. and the inner liner can also be turned inside out to view different configurations of compartments depending on the users wants and needs. For specialized bags, such as diaper bags, the component compartments can be oriented toward the bag's use, with compartments for wipes, diapers, change of clothes, etc. This allows for more versatility. Embodiments of the invention can also preferably include interchangeable straps which can be reversible or removed to change the look and function of the handbag; and double sided reversible slipcovers which can be interchangeable with other double sided reversible slipcovers. An optional embodiment of the invention allows other slipcovers to be stacked within each other, so that a plurality of slipcovers may be nested between the foundation bag and the outermost slipcover. Thus, the other slipcovers are held by the connection between the foundation bag and the outermost slipcover.

The outermost slipcovers are attached by either a conventional single post zipper or a dual post zipper. A conventional zipper, with one engagement post at its proximal end and a stop at its opposite distal end, is used on non-reversible slipcovers. However, a dual post zipper is always used on the top peripheral edge of reversible slipcovers, to facilitate proper engagement with the mating zipper slide and pull portion attached to the outer surface of the foundation bag. In this manner, a properly facing engagement zipper post is available to mate with the foundation bag regardless of the outer surface or orientation of the outer slipcover selected. A different separating-type zipper is used to attach the removable liner to the inside of the foundation bag. The zipper can be located along the upper, middle or lower regions of the foundation bag or a combination of one or more of these regions. The zipper mates with, and is fed into, a slide and pull portion of a corresponding zipper extended along various outside surfaces of the foundation bag. As a result, the outermost slipcover is suspended from the annular peripheral edge extending along the outside surface of the inner foundation bag. The zipper attaching the slipcover to the foundation bag can be optionally covered by a flap.

The position of the zipper on the foundation bag can vary, depending upon how much, if any, of the foundation bag is to be exposed above the outer slipcover. For example, if the zipper is at the top periphery of the foundation bag, then its outer surface will be completely hidden by the slipcover.

On the other hand, if the outer slipcover is shorter than the foundation bag, then a portion of the foundation bag will be exposed above the top periphery of the outer slipcover. In that case, the zipper on the foundation bag is located lower than at the top periphery of the foundation bag and mates with the zipper at the top periphery of the outer slipcover, exposing a portion of the foundation bag to view.

Additionally, each outer slipcover is also optionally reversible with a different design pattern, material, color, texture and/or embellishment on either side of the outer slipcover so that when turned inside out, the outer surface design is changed to meet the user's needs in order to change the look and function of the handbag.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 1A is a perspective view of the carry bag as in FIG. 1, showing sliding assembly of the decorative outer cover over the inner foundation bag, wherein the arrow indicates the sliding direction of the slipcover over the foundation bag.

FIG. 3 is a perspective view of an embodiment of a foundation bag with an interchangeable reversible lining.

FIG. 3A is a perspective view of the inside walls of the lining as in FIG. 3, showing pockets for items of personal use.

FIG. 3B is a perspective view of the lining as in FIG. 3, shown in a reversed inverted inside-out position.

FIG. 3C is a close up detailed top plan view of a portion of the foundation bag of FIG. 3, shown closed by a pair of fasteners.

To facilitate understanding, identical reference numerals have been used, wherever possible, to designate identical elements that are common to the figures.

DETAILED DESCRIPTION OF THE PREFERRED EMBODIMENT

So that the manner in which the above recited features of the invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

Figure 1:
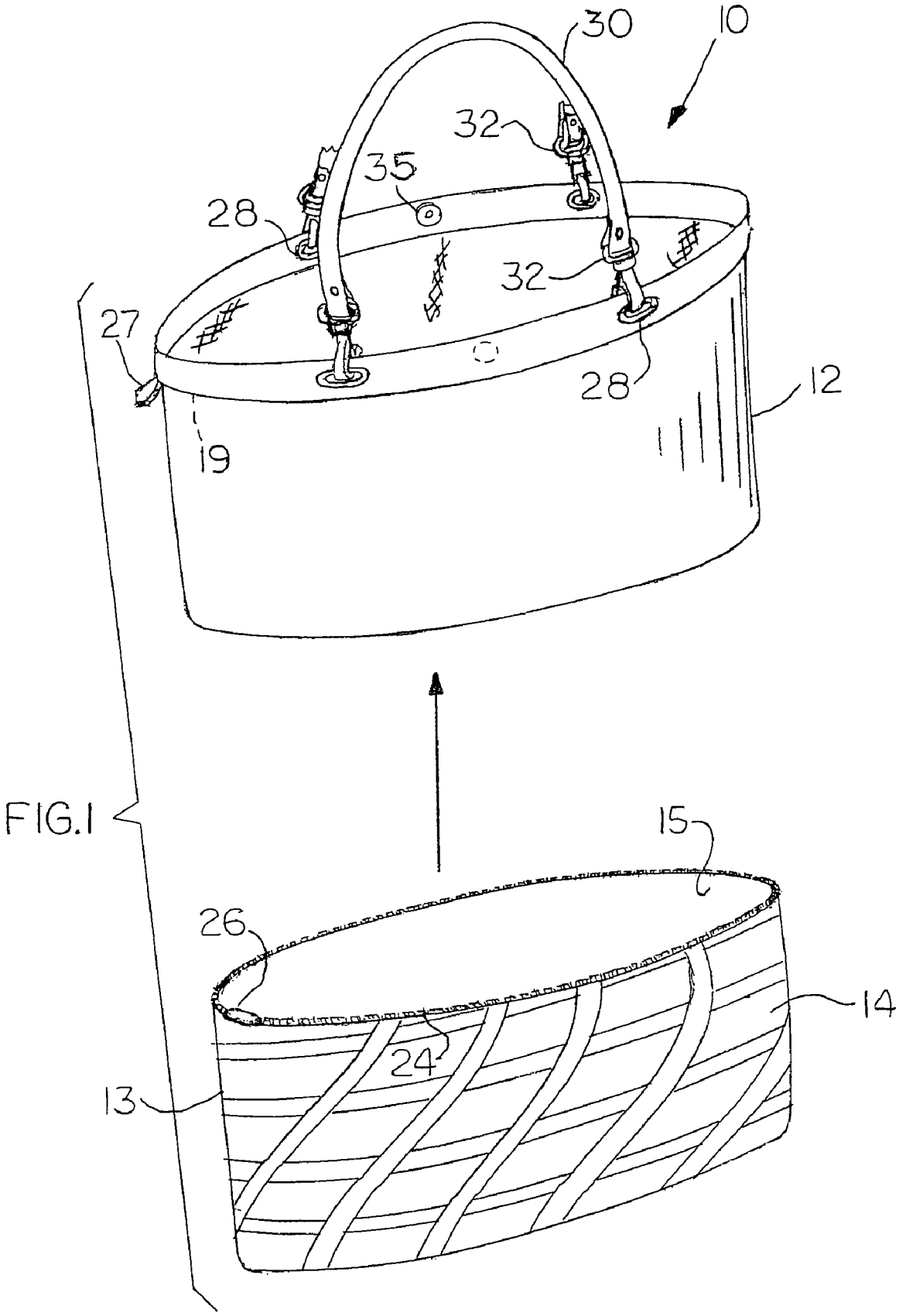
FIG. 1 is a perspective view of an embodiment of an interchangeable carry bag system, showing one handle in perspective and a cutaway view of the connecting end of a further handle wherein the arrow indicates the sliding direction of the slipcover over the foundation bag.

Specifically, FIG. 1 depicts an interchangeable carry bag system 10. The system 10 includes a discrete foundation bag 12 and a non-reversible outer slipcover 13. The outer slipcover 13 has a first outer surface 14 and a second inner surface 15. The first outer surface 14 is illustratively a decorative surface and can be made of material including but not limited to leather, suede, cotton, silk, etc. and can have a variety of decorative textures, patterns and embellishments. The second inner surface 15 is a lining of the outer slipcover 13 made of various materials including but not limited to cotton, polyester or other natural or manmade materials. The outer slipcover 13 contains a first fastening structure 24, which is located along the top periphery of the outer slipcover 13. The first fastening zipper structure 24 is one side of a standard zipper containing a single post 26. A user may slip the outer slipcover 13 over the foundation bag 12 and position the post 26 from the first fastening zipper structure 24 of the slipcover 13 into the slide and pull portion of the second fastening zipper structure 19 of the foundation bag 12, in order to interlock the outer slipcover 13 to the foundation bag 12 and create a different look for the handbag system 10. The process of zipping the outer slipcover 13 on and off is easy, simple and quick and is a preferred method of fastening the outer slipcover 13 to the foundation bag 12. Zipper slide and pull portion 19, located on an outer surface of foundation bag 12, is operated via zipper handle clasp 27.

In addition, FIG. 1 also depicts an optional handle 30. Illustratively, handle 30 is shown as a reversible handle, but it is known that non-reversible handles, such as handle 23 of FIG. 2C, may also be used, as well as no handle, in a clutch bag configuration. The handle 30 is coupled to the foundation bag 12 via connectors which may be oriented in different directions, such as, for example, swiveled loops 32 on the ends of the handles 30 which are looped through grommets 28 near the top periphery of the foundation bag 12. The swiveled loops 32 allow a user to rotate the handle 30 so that the opposing (i.e., previously unseen) side of the handle is now viewable to further alter the look of the foundation bag 12.

Figure 2:
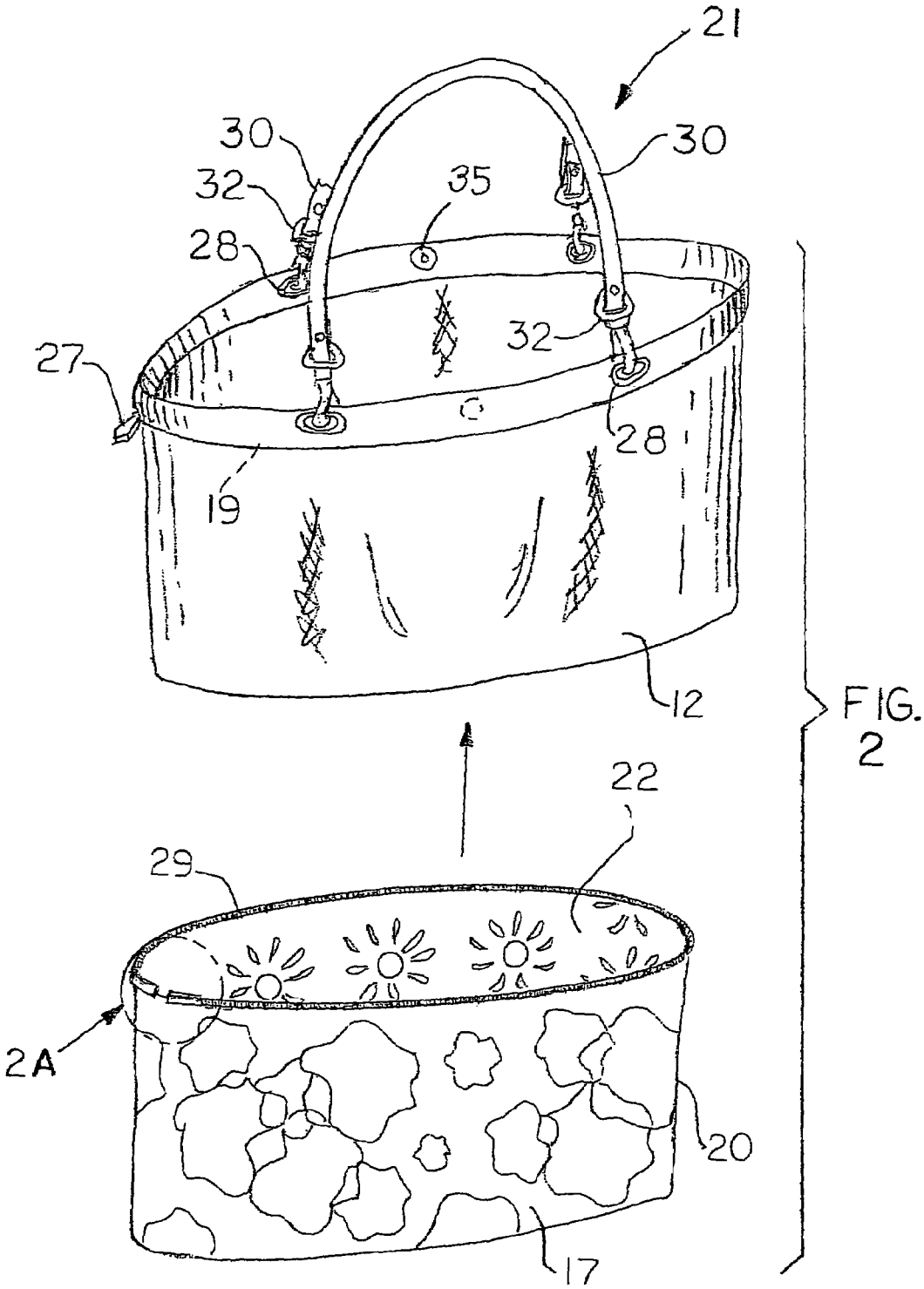
FIG. 2 is a perspective view of an embodiment of an interchangeable carry bag system showing a foundation bag and an outer slipcover which is reversible, showing one handle in perspective and a cutaway view of the connecting end of a further handle wherein the arrow indicates the sliding direction of the slipcover over the foundation bag.
Figure 2A:
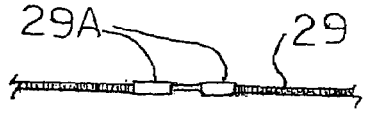
FIG. 2A is a close-up perspective view of a portion of the dual post zipper shown in FIG. 2, taken along the dashed line ellipse "2A" of FIG. 2.
Figure 2B:
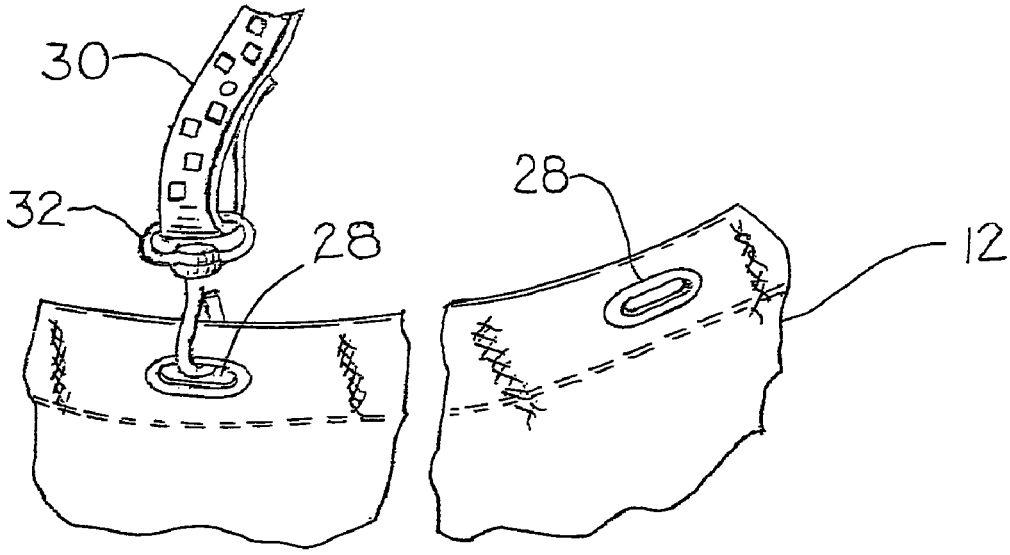
FIG. 2B is a close-up perspective view of connectors for optionally interchangeable reversible handles.
Figure 2D:
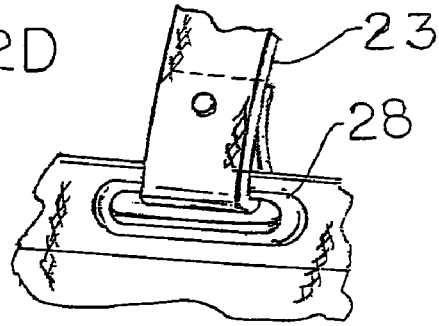
FIG. 2D is a close-up perspective view of an optional permanently attached handle joint for non-reversible straps taken along the dashed line ellipse "2D" of FIG. 2C.
Figure 2C:
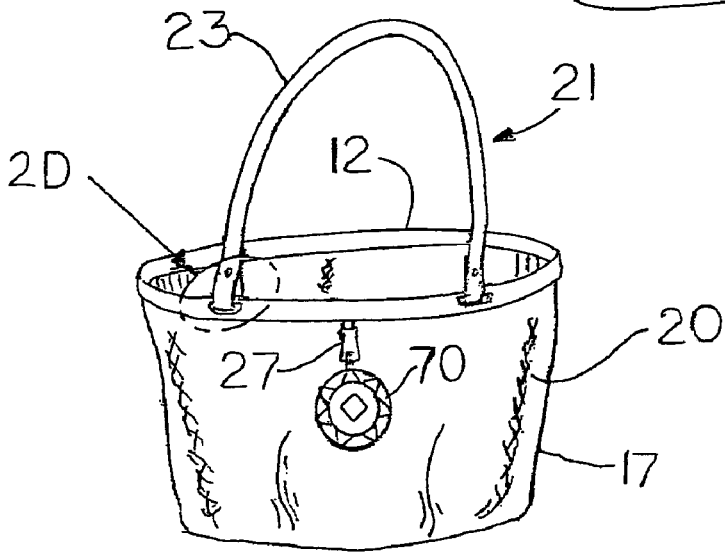
FIG. 2C is a perspective view of an alternate embodiment for a handbag system having a decorative pendant suspended from the zipper handle clasp, and showing a further embodiment for a permanently attached handle.

Although FIG. 1 depicts the handbag system 10 using handles 30 it is appreciated that the invention may be practiced without the use of handles 30 or with non reversible sewn-in or otherwise permanently attached handles 23 shown in FIG. 2C. Further, other embodiments of this invention can include other types of handles, fastening structures and other shapes, sizes and embellishments of the foundation bag 12 and outer slipcovers 13.

FIG. 1A is a perspective view of the handbag system 10 as described above and depicted in FIG. 1. Specifically, FIG. 1A shows non-reversible outer slipcover 13 partially slipped over foundation bag 12. A portion of the foundation bag 12 is lifted to show the zipper slide and pull portion 19 of foundation bag 12 ready for interlocking with the single post zipper portion 24 of outer slipcover 13. The elements in FIG. 1A have been already described with respect to FIG. 1. For brevity, a description of those elements is not repeated.

FIG. 2 is a perspective view of another embodiment of an interchangeable carry bag system 21. Specifically, FIG. 2 depicts a handbag system 21 having a foundation bag 12 and an outer slipcover 17 which is reversible. Many of the elements of the handbag system 21 depicted in FIG. 2 have been previously depicted and described with respect the handbag system depicted in FIG. 1. As such, and for the purpose of brevity, a description of those elements is not repeated.

The outer slipcover 17 has a first decorative outer surface 20 and a second decorative inner surface 22. The outer surface 20 and inner surface 22 are both decorative surfaces made from a wide variety of materials. Each surface (20 and 22) has its own distinctive decorative color, pattern, texture and/or embellishments. The outer reversible slipcover 17 also contains a dual post fastening zipper structure 29 which is located along the top periphery of the outer reversible slipcover 17. The dual post fastening structure is one side of a zipper. The zipper post portion 29 contains axially oriented dual posts 29*a* at opposite ends thereof, which are also shown in a close-up detail view in FIG. 2A. The user may turn the outer reversible slipcover 17 inside out to reveal the second surface 22. The user may slip the outer reversible slipcover 17 over the foundation bag 12 and position one post 29*a* from the dual post fastening structure 29 of the outer reversible slipcover 17 into the slide and pull portion of the second fastening structure 19 of the foundation bag 12, in order to interlock the outer reversible slipcover 17 to the foundation bag 12 and create another different look. The reversible slipcover 17 of FIG. 2 offers more options to the user than the nonreversible slipcover 13 of FIG. 1. Thus, when utilizing the interchangeable carry bag system according to this embodiment, the user can obtain four different appearances for the handbag system by using the foundation bag 12 by itself, without an outer slipcover; using the foundation bag 12 with the non-reversible outer slipcover 13; or using the foundation bag 12 with reversible outer slipcover 17 in either orientation, with either its outer side or inner side exposed. It is appreciated that other embodiments of the invention can include other types of fastening structures and other shapes, sizes and embellishments of foundation bags and slipcovers. FIG. 2 also shows closure member 35 to close the top of foundation bag 12 with closure member 36 of FIG. 3C.

FIG. 2A is a close-up perspective view of a portion of the dual post zipper portion 29 shown in FIG. 2. Specifically, FIG. 2A depicts a first side portion 29 of a zipper which interlocks with a mating second slide and pull portion 19 of the zipper, located under the optional flap shown in FIG. 2, on an outer surface of the foundation bag 12. The first side of the zipper post portion 29 has dual posts 29*a* located at each end of the first side of the zipper 29. The dual post 29*a* allows a user to interlock the first and second portions (29 and 19) of the zipper regardless of the outer or inner side (20 and 22) of the outer slipcover 17 being exposed outwardly.

FIG. 2B is a close-up perspective view of optionally interchangeable reversible handles 30. The handles 30 shown in FIG. 2 operate as described above with respect to FIGS. 1 and 3.

FIG. 2C is a perspective view of an alternate embodiment for a carry bag system 21 having an optional decorative pendant 70 suspended from a zipper handle pull clasp 27. As opposed to the normal engaged (zipped) position of zipper handle pull clasp 27 shown in FIGS. 1–3 at the left side of foundation bag 12, if a decorative pendant 70 is used, this zipped position of pull clasp 27 on zipper side portion 19 is relocated to the outer side center of foundation bag 12, as shown in FIG. 2C. Preferably, to maintain the pendant 70 in the center of foundation bag 12, zipper slide and pull portion 19 would require a post, to stop the zipper slide and pull portion 19 at the center of foundation bag 12. It is appreciated that the decorative pendant 70 can be made from any type of material, be of any color, and any shape; and be used in accordance with the invention. Furthermore, it is noted that the zipper post 26 or 29*a* can be located anywhere along the outer side surface of foundation bag 12, so that the zipper handle pull clasp 27 can be conveniently positioned to allow for minimal pulling effort and torque to slide the handle clasp 27 along zipper portions 19 and 29 of the reversible bag or 19 and 24 of the non-reversible bag. In addition, FIG. 2D depicts a handle 23 permanently attached to the foundation bag 12 and not having a swivel portion. It is also further noted that non-reversible, permanently attached handles 23 can be used in other embodiments, instead of the reversible handle 30 coupled to the foundation bag 12 via multi-directionally oriented connectors, such as, for example, swiveled loops 32 and garments 28. However, if reversibility is not required, then non-reversible handles 23 can be used.

Figure 5:
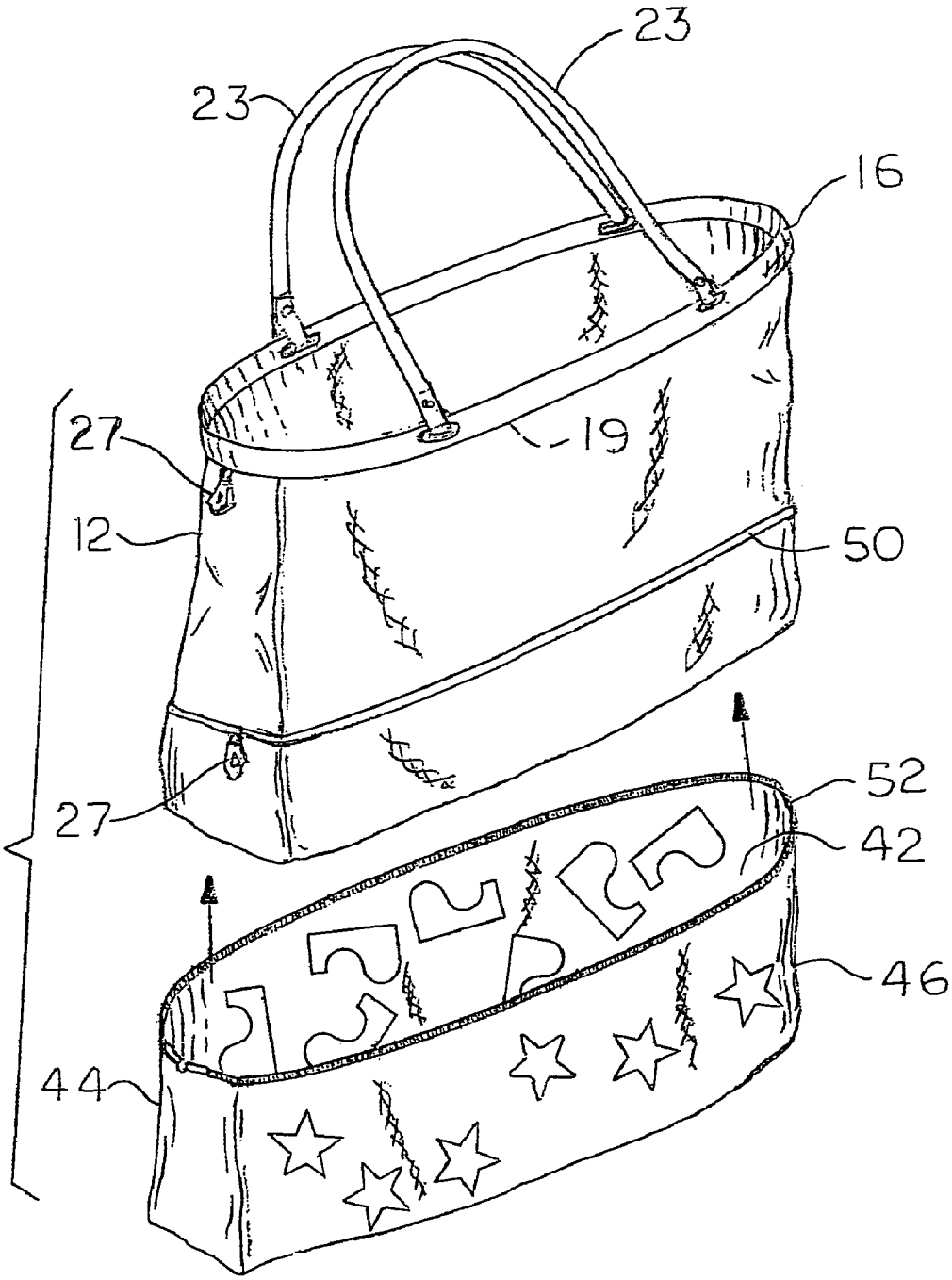
FIG. 5 is a perspective view of another embodiment of an interchangeable carry bag system showing a foundation bag and a different sized partial outer slipcover wherein the arrow indicates the sliding direction of the partial slipcover over the foundation bag.

FIG. 3 is a perspective view of an embodiment of a handbag system with an interchangeable lining 37. Specifically, FIG. 3 depicts a foundation bag 12 which can be made of various flexible materials including but not limited to leather, suede, silk, etc. The foundation bag 12 can be worn and used without the use of an outer slipcover 13 or 17 or without liner 37. The foundation bag 12 preferably has a first fastening closure structures 35, 36 (shown in FIG. 3C), attached to the foundation bag 12 for closing the foundation bag 12. The first fastening closure structures 35 and 36 may be opposite magnetic closures but is not limited to such, and can include a zipper, drawstring, snap, buckle, hook and loop or other closing mechanism capable of joining the opposing sides of foundation bag 12 together. For example, the first fastening structures 35 and 36 can be magnetic snap type fasteners of opposite polarity. Optionally the foundation bag 12 has a second fastening structure 19 (e.g., a zipper slide and pull portion) located on the outer surface of the foundation bag near the top periphery thereof as depicted in FIGS. 1 and 2. The second fastening structure 19 mates with the single post zipper portion 24 of a full sized non-reversible slipcover 13 or mates with a dual post zipper portion 29 of a reversible slipcover 17. Zipper slide and pull portion 50 may be located on the lower region of the foundation bag 12 as depicted in FIG. 5 to mate with a dual post zipper portion 52 of a partial sized slipcover 44. The location and number of second fastening structures, such as zipper slide and pull portions 19 or 50, located upon foundation bag 12, may vary depending on the size of outer slipcover 13, 17 or 44 being applied and the amount of versatility demanded by the consumer of the foundation bag 12. For example, a foundation bag 12 that contains three second fastening structures, such as zipper slide and pull portions 19, located at the top, middle and bottom regions respectively of foundation bag 12, can receive a variety of different sized slipcovers (full, mid region and lower region slipcovers respectively). However, the foundation bag 12 that contains only one second fastening zipper slide and pull portion structure 19 or 50 can receive one sized non-reversible outer slipcover 13,—reversible outer slipcover 17 or partial outer slipcover 44.

The foundation bag 12 with a liner 37 is also depicted in FIG. 3 with a pair of straps 30 which together form a handle for holding the foundation bag 12. Straps 30 can be made of rigid or flexible material, including but not limited to leather, belting, cording, plastic, beading etc. Similar to straps 30 of FIGS. 1 and 2, the straps 30 may be interchangeable and may be fastened to the foundation bag 12 by a third multi-directionally oriented fastening structure such as swivelable loops 32 and grommet 28, as described before in FIG. 1. In addition to the advantages of the interchangeable straps 30 described above, the interchangeable straps 30 also allow the user to disconnect the straps 30 for a variety of other reasons e.g., to replace damaged, frayed straps; to change the original straps for another pair of straps 30 of a different length or style; and for aesthetic purposes of reversing the straps 30 to wear on the opposite side revealing a different color, or pattern, or to remove the straps 30 for a strapless clutch hand bag. The third fastening structure 28 and 32 is for illustrative purposes and is not intended in any way to limit the scope of the hardware or fastener used to connect the strap 30 to the foundation bag 12. It can also be appreciated that other embodiments of the invention can include other types of straps, such as non-reversible sewn-in straps 23 of FIG. 2D, the quantity of straps 30 or 23, or no strap at all.

FIGS. 3, 3A and 3B depict the preferably reversible lining 37 which can be made of various flexible materials including but not limited to cotton, polyester, silk, satin etc. FIG. 3A shows two inner side walls of the lining 37 in a first position of use with pockets for items of personal use such as a cell phone, glasses, tissues, keys, credit cards, as well as a large zipped compartment for miscellaneous items wherein the large compartment may have small subcompartments. For specialized bags, such as diaper bags, the compartments may include wet wipes, moist towelettes, diapers and/or change of clothes, etc. FIG. 3B shows lining 37 in a reverse, inverted, inside-out position. While lining 37 is preferably reversible so it can be used inside out, it can be provided also as a non-reversible lining. The lining 37 may be interchangeable and may be fastened to the foundation bag 12 by a fourth fastening structure 39, such as a zipper post portion, located along the top peripheral edge of the liner 37 and the corresponding zipper slide and pull portion 43 located along the top inside periphery of the foundation bag 12, so that when the post side 41 of the fourth fastening structure 39 is fed into the slide and pull side of the zipper portion 43 located on the inner upper surface of the foundation bag 12, the lining 37 and foundation bag 12 interlock in position. The optionally interchangeable liner 37 allows the user to remove the existing lining 37 for a variety of reasons e.g., for cleaning purposes, to discard and replace an irreparably damaged liner (e.g., ripped, soiled etc.) or for the aesthetic purpose of choosing another color, texture or pattern lining. Optionally lining 37 may be provided with dual post zipper portion 41 to facilitate the proper engagement with the zipper side and pull portion 43 on foundation bag 12. When turned inside out, the lining 37 may have inner compartments such as at least one zipper compartment 45 to keep items secure and one or more pockets 47 to hold various personal items such as keys, tissues, cell phone etc. The lining inner compartments 45 and/or 47 are for illustrative purposes and are not intended to limit the scope of the invention. As such, other embodiments of the invention can include other types and amounts of compartments with different closures. It is appreciated that the liner 37 may include more or less compartments than depicted in FIG. 3 or no compartments at all.

FIG. 3C is a top plan view of the foundation bag 12 of FIG. 3, shown closed by a fastener 35 attached to another fastener 36. Elements such as handles 30, loops 32, grommets 28 and foundation bag 12 have already been described with respect to FIGS. 1, 2, 2B, and 3. For brevity, those elements are not further described with respect to 3C. In addition to those elements already described, illustratively, fasteners 35 and 36 are depicted as magnetic type fasteners having two magnetic portions of opposite magnetic polarity. The magnetic attraction between magnetic portions 35, 36 and a snap feature is sufficient to hold the foundation bag 12 is a closed position when desired. Although FIG. 3C depicts the fasteners 35 and 36 as magnetic closures it is appreciated that any type of fastener can be used in accordance with the invention (e.g., snap, magnetic snaps, hook and loop VELCRO® fasteners or a zipper).

Figure 4:
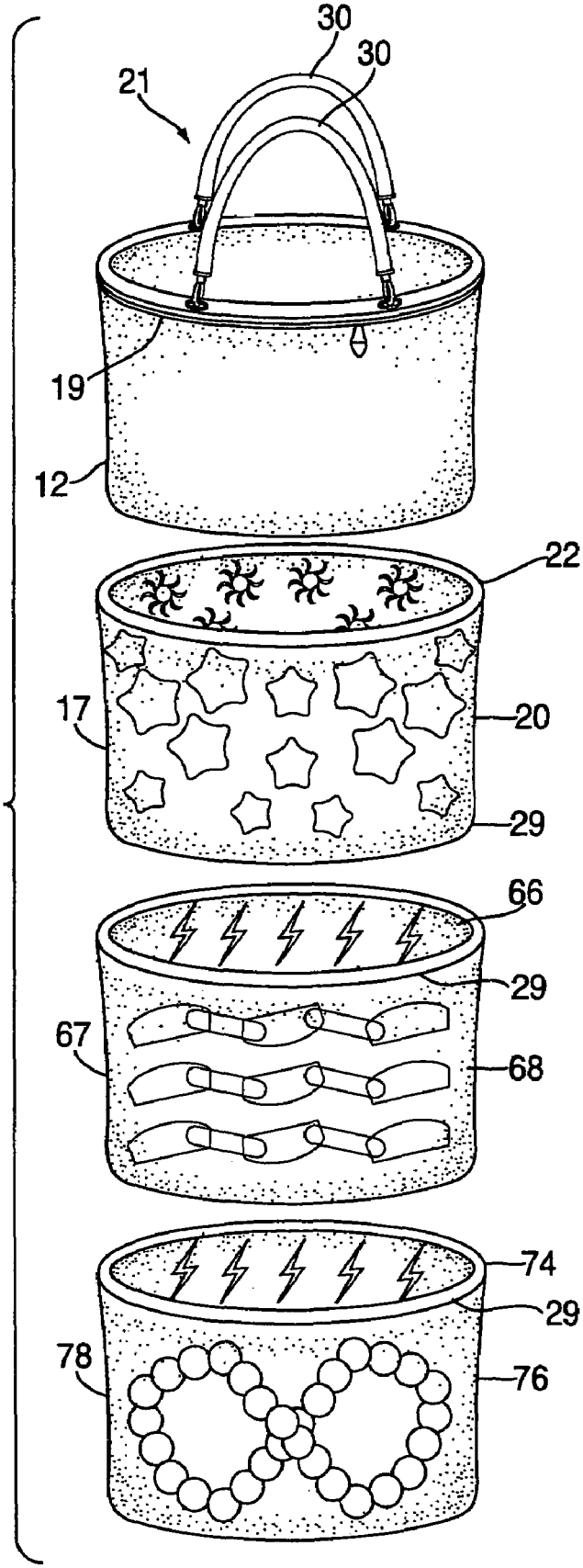
FIG. 4 is a perspective view of the interchangeable carry bag system of FIGS. 1 and 2, showing a foundation bag and multiple stackable and reversible outer slipcovers.

FIG. 4 is a perspective view of the interchangeable carry bag system 21 of FIG. 2 showing foundation bag 12 and multiple stackable outer reversible slipcovers 17, 67 and 78. Specifically, FIG. 4 shows the stackability aspect of multiple outer reversible slipcovers 17, 67 and 78. In addition to outer slipcover 17 described with respect to the embodiments of FIG. 2, FIG. 4 depicts two additional outer slipcovers (67 and 78). Each additional slipcover 67 and 78, as illustrated, is also reversible, however nonreversible slipcovers such as outer slipcovers 13 of FIG. 1 may be used, or a combination of reversible and nonreversible slipcovers may be used. Outer slipcover 67 includes a first inner surface 66 and second outer surface 68, and a dual post zipper portion 29. Outer slipcover 78 includes a first inner surface 74, a second outer surface 76, and a dual post zipper portion 29.

The embodiment depicted in FIG. 4 operates similarly to that described with respect to FIGS. 1–3. However, the outer slipcover 17 is not interlocked with foundation bag 12. Rather, the outer slipcover 17 is merely slipped over the foundation bag 12. Thereafter, outer slipcover 67 is slipped over outer slipcover 17 without interlocking the outer slipcover 67 to the foundation bag 12. Afterwards, outer slipcover 78 is slipped over outer slipcover 67 and interlocked to foundation bag 12 via the dual posted zipper 29 being inserted into the second fastening structure 19 of the foundation bag 12. The outer slipcovers 17 and 67 are nested between the foundation bag 12 and outermost slipcover 78 and therefore held in place by the interlocking of the foundation bag 12 with the outermost slipcover 78. Since the outer slipcovers 17, 67 and 78 are flexible, each can have the same size as each other slipcover. Inner placed slipcovers 17 and 67 are not fastened by zippers, but rather are loosely nested within each other. In this illustration of FIG. 4, each of the outer slipcovers 17, 67 and 78 allow the user two different appearances for the handbag system. Thus, the three outer slipcovers (17, 67 and 78) allow the user six different appearances for the foundation bag 12. In addition, the user has at their disposal a seventh appearance for the foundation bag 12 itself, if the user decides to use none of the outer slipcovers 17, 67 and/or 78, since the foundation bag 12 is a completely functioning handbag on its own. It is appreciated that the number of outer slipcovers 17, 67 or 78 can vary, depending on the needs of a particular user and that more or fewer reversible outer slipcovers 17, 67 or 78 and/or nonreversible outer slipcovers 13 may be used in accordance with the invention.

FIG. 5 is a perspective view of an embodiment of an interchangeable carry bag system showing a foundation bag and a different sized outer slipcover. FIG. 5 depicts some of the elements previously described with respect to FIGS. 1–4. For the purpose of brevity, the function and description of those elements is not repeated. In addition to those features previously described, FIG. 5 also depicts a second zipper post portion 52 located on a top peripheral edge of an outer partial slipcover 44. The outer reversible slipcover 44 includes a dual post zipper side portion 52, a first inner surface 42 and a second outer surface 46. The partial outer slipcover 44 can optionally be nonreversible and would therein include a standard single post zipper portion for purposes of interlocking itself to zipper slide and pull portion 50 located on the outer surface of the foundation bag 12. In FIG. 5 the partial slipcover 44 may be slipped over the lower portion of the foundation bag 12 and interlocked using the zipper slide and pull portion 50 and dual post zipper portion 52. Although FIG. 5 depicts a single partial outer slipcover 44 it is appreciated that other partial slipcovers of the same size may be nested between foundation bag 12 and outer partial slipcover 44 as similarly described with respect to FIG. 4.

It is appreciated that many different types (i.e. sizes and styles) and the amount of zippers place on the outside of the foundation bag 12 will vary and can also be used in accordance with the invention. It is also noted that the zipper slide and pull portions (19 and/or 50) located on the outside of the foundation bag 12 may be hidden via a flap of material on the foundation bag itself or it may be in full view and its function is also and aspect of its design.

While the foregoing is directed to embodiments of the present invention, other and further embodiments of the invention may be devised without departing from the basic scope thereof, and the scope thereof is determined by the claims that follow. Illustratively, the invention has been described as having a pull and slide zipper portion on the foundation bag, and either a single post or dual post zipper portion on the slipcover. However, those illustrations are not intended to limit the scope of the invention in any way. For example, the pull and slide zipper portion can be located on the slipcover and either the single post or dual post zipper portion can be located on the foundation bag.

It is appreciated that many different types (e.g., sizes and styles) of foundation bag and covers can be used in accordance with the invention. While the foregoing is directed to embodiments of the present invention, other and further embodiments of the invention may be devised without departing from the basic scope thereof, and the scope thereof is determined by the claims that follow.

The invention claimed is:

1. An interchangeable carrying bag system, comprising:

a discrete foundation bag having an inner surface and an outer surface;

a reversible outer slipcover having a top periphery, an inner surface and an outer surface;

a first zipper portion connected to said foundation bag; and a second zipper portion connected to said top periphery of said reversible outer slipcover;

wherein at least one other outer slipcover is stacked between said foundation bag and said outer slipcover.

2. An interchangeable carrying bag system, comprising:

a discrete foundation bag having an inner surface and an outer surface;

a reversible outer slipcover having a top periphery, an inner surface and an outer surface;

a first zipper portion connected to said foundation bag; and a second zipper portion connected to said teD periphery of said reversible outer slipcover;

further comprising at least one other zipper portion on said outer surface of said foundation bag;

further comprising another outer slipcover, interlockable with said at least one other zipper portion wherein said another outer slipcover has an outer surface, an inner surface, and a top periphery wherein said top periphery has a zipper portion attached thereto;

wherein said another outer slipcover is reversible; and, wherein said zipper portion on said top periphery of said another outer slipcover is a dual post zipper.

3. An interchangeable carrying bag system, comprising:

a discrete foundation bag having an inner surface and an outer surface;

a reversible outer slipcover having a top periphery, an inner surface and an outer surface;

a first zipper portion connected to said foundation bag; and a second zipper portion connected to said top periphery of said reversible outer slipcover;

further comprising at least one other zipper portion on said outer surface of said foundation bag;

further comprising another outer slipcover, interlockable with said at least one other zipper portion, wherein said another outer slipcover has an outer surface, an inner surface, and a top periphery wherein said top periphery has a zipper portion attached thereto;

further comprising at least one other outer slipcover stacked between said foundation bag and said another outer slipcover.

4. An interchangeable carrying bag system, comprising:

a discrete foundation bag having an inner surface and an outer surface;

a reversible outer slipcover having a top periphery, an inner surface and an outer surface;

a first zipper portion connected to said foundation bag; and a second zipper portion connected to said top periphery of said reversible outer slipcover;

further comprising a removable liner coupled to the foundation bag;

wherein said removable liner is reversible.

5. An interchangeable carrying bag system, comprising:

a discrete foundation bag having an inner surface and an outer surface;

an outer slipcover having a ton periphery, an inner surface, and an outer surface;

a first zipper portion connected to said foundation bag; and a second zipper portion connected to a slipcover;

wherein at least one other outer slipcover is stacked between said foundation bag and said outer slipcover.

6. An interchangeable carrying bag system, comprising:

a discrete foundation bag having an inner surface and an outer surface;

an outer slipcover having a top periphery, an inner surface, and an outer surface;

a first zipper portion connected to said foundation bag;

a second zipper portion connected to a slipcover;

another outer slipcover, interlockable with said at least one other zipper portion, wherein said another outer slipcover has an outer surface, an inner surface, and a top periphery wherein said top periphery has a zipper portion attached thereto;

wherein said at least one other zipper portion is a slide and null zipper portion and said zipper portion on said top periphery of outer slipcover is a dual post zipper; and, at least one other outer slipcover stacked between said foundation bag and said another outer slipcover.

7. A method for interchanging carrying bags, comprising the steps of:

providing a discrete foundation bag having a top periphery, a zipper portion, an inner surface and an outer surface;

providing an outer slipcover having a top periphery, an inner surface and an outer surface;

providing a first zipper portion attached to said outer surface of said foundation bag and a second zipper portion attached to said top periphery of said outer slipcover;

sliding said outer slipcover over said foundation bag; and interconnecting said foundation bag to said outer slipcover using a single post zipper further comprising nesting at least one other outer slipcover between said foundation bag and said outer slipcover.

* * * * *